United States Patent [19]

Herb

[11] 3,980,007

[45] Sept. 14, 1976

[54] AIR CONDITIONING TERMINAL

[75] Inventor: Carl C. Herb, Camillus, N.Y.

[73] Assignee: Carrier Corporation, Syracuse, N.Y.

[22] Filed: June 10, 1975

[21] Appl. No.: 585,558

[52] U.S. Cl. ..... 98/40 D; 98/103; 236/49

[51] Int. Cl.[2] ..... F24F 13/08

[58] Field of Search ..... 98/40 C, 40 D, 103; 236/49

[56] References Cited

UNITED STATES PATENTS

| | | | |
|---|---|---|---|
| 3,185,069 | 5/1965 | Straub et al. | 98/40 D |
| 3,677,164 | 7/1972 | Traver et al. | 98/40 D |

*Primary Examiner*—William E. Wayner
*Assistant Examiner*—Henry C. Yuen
*Attorney, Agent, or Firm*—J. Raymond Curtin; Barry E. Deutsch

[57] ABSTRACT

An air conditioning terminal including first and second damper assemblies, with each assembly having an outer wall spaced from an outer terminal wall to define first and second air passages. The assemblies further include inner walls spaced from a centrally located vertically extending wall to define third and fourth air passages. The terminal further includes a diffuser section including side diffuser members having a portion including a curved surface spaced from sides of the centrally located wall extending generally parallel thereto to define a section to streamline the air flowing from the first and third air passages towards the air from the second and fourth air passages to limit turbulence. The central vertically extending wall includes a baffle to direct the air streams downwardly prior to their intermixing to further minimize turbulence.

6 Claims, 1 Drawing Figure

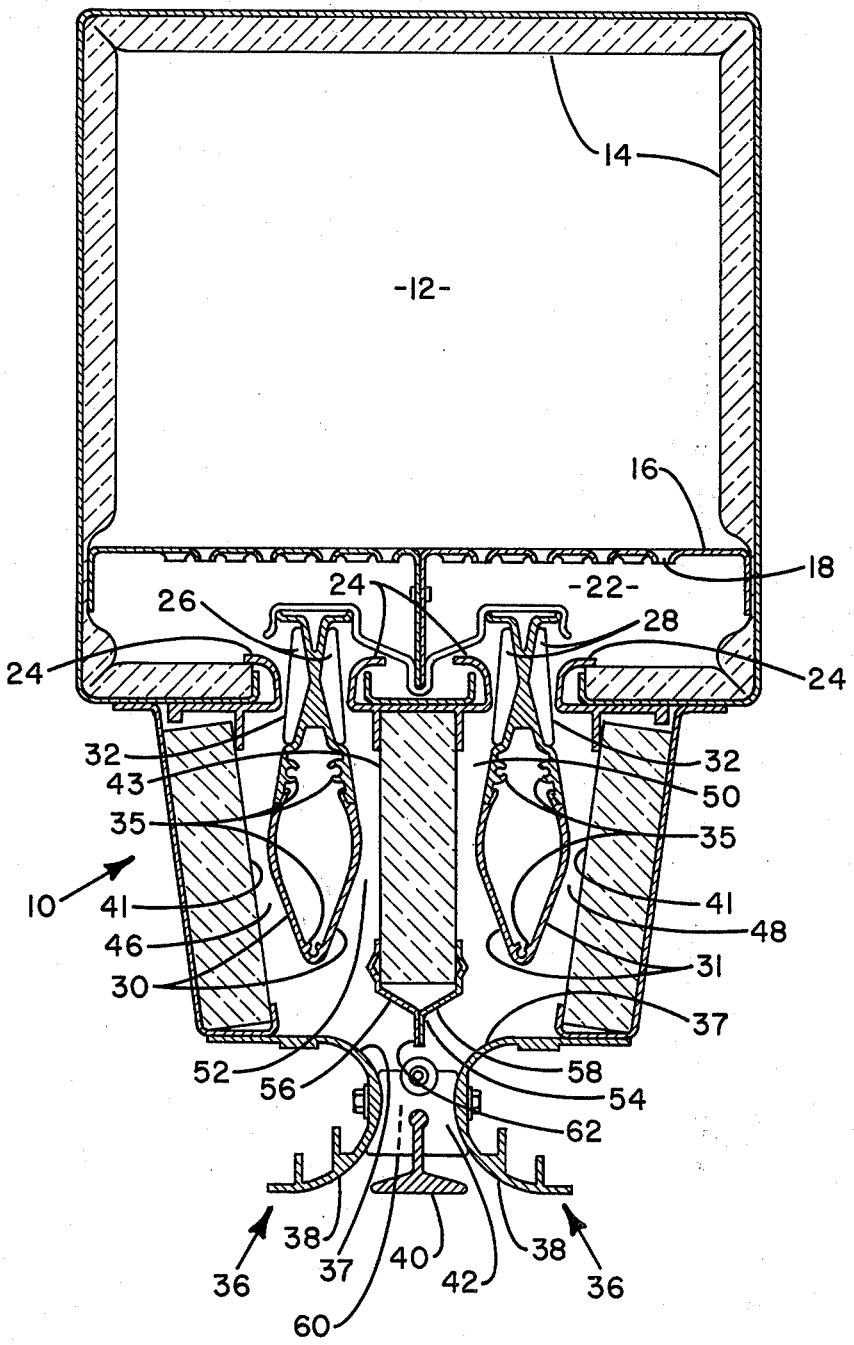
14
-12-
16
18
-22-
24
26
28
24
24
32
43
32
50
35
35
10
41
41
46
48
30
31
37
52
56
58
54
62
38
37
40
42
38
36
36
60

AIR CONDITIONING TERMINAL

BACKGROUND OF THE INVENTION

This invention relates to air conditioning terminals having a plurality of air stream passages, and in particular to a terminal designed to limit turbulence produced as a result of the intermixing of the air streams flowing through the various air passages.

The utilization of air conditioning terminals to supply conditioned air from a central source thereof to offices, schoolrooms, and other similar spaces in multi-room buildings has become increasingly prevalent. Such terminals are typically located in the ceiling of the rooms being conditioned, or on the floor thereof adjacent the windows. The use of such terminals in rooms normally occupied by people dictates that the conditioned air be discharged from the terminals as quietly as possible. That is to say, noise generated by operation of the terminal should be maintained at a minimum.

An air conditioning terminal of the type suitable for installation in a ceiling that has met with widespread commercial success is disclosed in U.S. Pat. No. 3,554,111, issued Jan. 12, 1971 and assigned to the same assignee as the assignee hereof.

The terminal disclosed in the aforecited patent includes an assembly for regulating the quantity of conditioned air discharged into the room or space being conditioned in accordance with the actual temperature requirements of the occupants thereof. Such air regulating assembly includes an inflatable bellows, the amount the bellows is inflated varying inversely with the quantity of conditioned air discharged from the terminal.

The conditioned air is supplied to each of the terminals from a central station refrigeration machine via suitable ducts. Each terminal includes a plenum section in communication with a supply duct. A terminal further includes a distribution chamber having an air regulating assembly disposed therein. A plate having a plurality of openings is interposed between the plenum section and the distribution chamber.

In the terminals of the prior art, essentially two separable air streams were defined in the terminal. The separate streams flowed downwardly through the terminal and were discharged from the unit via two separate discharge slots.

In newer terminals, it has been deemed desirable to increase the quantity of conditioned air discharged therefrom to meet the requirements of certain applications. It has been necessary to provide a second air regulating assembly in the newer terminals of the type described to accommodate the increased quantity of air flowing through the unit. The second assembly defines a pair of air flow paths parallel to the flow paths defined by the first assembly.

Thus, four separate air streams are defined within the terminal. Since the terminal continues to have only two discharge slots, it is necessary that the separate air streams be combined "upstream" from the discharge slots. As the air is moving at a considerable velocity, uncontrolled intermixing of the streams would cause turbulence, thereby reducing the efficiency of operation of the terminal, and also possibly resulting in the generation of undesirable noise.

SUMMARY OF THE INVENTION

It is therefore an object of this invention to intermix separate air streams upstream from a discharge slot of an air conditioning terminal.

It is a further object of this invention to intermix such air streams without creating turbulence.

It is yet another object of this invention to intermix separate air streams upstream from a discharge slot of an air terminal by directing the air streams in a parallel direction prior to their intermingling in a mixing space.

These and other objects of the present invention are attained in an air conditioning terminal provided to discharge conditioned air into a space. The terminal includes first and second damper assemblies. The outer wall of each assembly is spaced from an outer wall of the terminal to define first and second air passages. An inner wall of each assembly is spaced from a vertically extending, centrally located wall of the terminal to define third and fourth air passages, with the third and fourth passages being disposed radially inward relative to the first and second air passages. The terminal further includes a diffuser section comprising first and second diffuser members having a third diffuser member interposed therebetween to define first and second air discharge openings. The first and second diffuser members include a portion having a curved surface spaced from the lower sides of the vertically extending wall of the terminal to define therebetween a section to streamline the air flowing from the first and third air passages towards the air flowing from the second and fourth air passages. The vertically extending wall includes a baffle to direct the air streams downwardly prior to their intermixing.

BRIEF DESCRIPTION OF THE DRAWING

The single FIGURE of the drawing is a somewhat schematic sectional illustration of an air conditioning terminal including the instant invention.

DESCRIPTION OF THE PREFERRED EMBODIMENT

Referring now to the drawing, there is shown an air conditioning terminal illustrating a preferred embodiment of the present invention. Terminal 10 is representative of air conditioning terminals which are designed to be mounted in the ceiling of rooms or spaces being conditioned. Terminal 10 is provided as a part of an air conditioning system generally including centrally located air conditioning apparatus which may comprise a filter, precooling coil, spray means, a cooling coil, heating coil, and a fan for heating, cooling, dehumidifying, humidifying, and filtering the air as desired. A fan is provided to distribute the conditioned air through supply ducts which are provided to supply the conditioned air to the conditioning terminals located throughout a building.

Terminal 10 includes a primary chamber or plenum section 12, lined with sound absorbing material 14, such as a glass fiber blanket. The plenum section is ordinarily open at both ends for connecting a series of terminals end to end to provide a complete air distribution system. Suitable end pieces, not shown, are utilized to cap end terminals in a series. An air supply distribution plate 16, having a plurality of openings 18, is provided to evenly distribute supply air from plenum section 12 into a distribution chamber 22 defined by the top and side walls of distribution plate 16.

The bottom of distribution chamber 22 includes aligned cutoff plates 24. The plates cooperate with selectively inflatable bellows or bladders 26 and 28, to form a pair of air regulating or damper assemblies. Bladders 26 and 28, when fully inflated, typically form a pear-shaped configuration. Each of the bladders are adhesively mounted on a central partition assembly comprised of opposed generally convex plates 30 and 31. These plates have a V-shaped recess therein so the bladders are completely recessed within the plates when they are deflated. This provides a large area between the active walls 32 of the bladders and cutoff plates for maximum air flow therebetween. Further, the recessed bladder provides a smooth surface along the plates 30 and 31, to minimize air turbulence. Walls 32 of the bladders are normally concave. Therefore, when the bladders are fully deflated, the active walls of the bladders are out of the air stream to minimize the possibility of bladder flutter. By recessing the bladders within plates 30 and 31 and by providing the bladders with concave walls 32, the distance between the cutoff plates and wall 32 of the bladders is increased. This provides a greater opening between the bladders and cutoff plates when the bladders are fully deflated for maximum air flow therebetween. Further, a large movement of wall 32 from the concave position to a convex position may be obtained without stretching the bladder material. Plates 30 and 31 include slotted openings 35 to receive suitable means, such as screws or bolts, to connect the plates to end plates not shown.

An outlet assembly comprises side diffuser members 36 having outwardly flared lower portion 38 thereon and center diffuser member 40. The diffuser members are suitably connected to member 42 which functions as a connecting piece to join the three diffuser members into a subassembly. Preferably, the terminal further includes sound absorbing material, such as glass fiber blankets 41 disposed downstream of the air regulating assemblies. Blankets 41 define the outer walls of the terminal. The fiber blankets absorb sound waves of mid and high frequency. The blankets are ineffective in attenuating sound in the low frequency range.

Essentially, the ceiling air terminal hereinbefore described is of conventional construction and is more fully disclosed in the previously cited U.S. Pat. No. 3,554,111. The distinction between the terminal described hereinabove and the terminal illustrated in the aforecited patent is the present addition of a second air regulating assembly. It has been found that, in order to satisfy the requirements of many applications, it has been necessary to increase the quantity of conditioned air capable of being supplied from the terminal. Heretofore, the maximum quantity of air that units of the type described have been able to provide has been approximately 200 cfm.

In order to effectively control the discharge of an increased quantity of conditioned air, it has been necessary to provide second air regulating or damper assemblies. The second air regulating assembly defines third and fourth flow paths parallel to the conditioned air flow paths defined by the first air regulating assembly. As noted previously, the second assembly includes an additional pair of cutoff plates, bladders, and partition assembly comprising a pair of convex plates.

The terminal disclosed herein includes a vertically extending wall 43 disposed substantially on the vertical axis of the terminal. The wall separates the two radially inner air streams flowing through passages 50 and 52.

Preferably, wall 43 is formed from sound absorbing material so that the two air streams flowing downwardly along the outer surfaces thereof will be attenuated.

Essentially, four separate air streams are provided within the unit downstream from the air regulating dampers. It is necessary that such air streams be combined for proper discharge through the air discharge slots defined between the side diffuser members and the inner diffuser member. In order to prevent efficiency loss, and in addition, to prevent the generation of noise, the intermixing of such air streams must be accomplished without creating undue turbulence.

Since the discharge slots are substantially in line with the center dividing wall 43, it is necessary that the air streams flowing through outer air passages 46 and 48 be directed radially inward to combine with the air streams flowing through inner air passages 50 and 52. Side diffuser members 36 are flared at their upper end 37 to properly direct the air streams radially inward. By flaring the side diffuser members in the foregoing manner, the air streams are confronted by a curved surface which gradually directs the air in the desired direction.

In addition, inner wall 43 includes a member 54 attached to its lower surface. Member 54 includes sides 56 and 58 spaced above the upper inner surface of the side diffusers to define therebetween sections to streamline the air streams passing therethrough and which direct the air in a generally 45° flow path towards mixing space 60. By gradually changing the direction of the air streams passing into space 60, turbulence created as a result of the intermixing is maintained at a minimum.

Member 54 is generally shaped to define an isosceles triangle with sides 56 and 58 being equal in length. Sides 56 and 58 extend generally parallel to the curved portion of the surface of the side diffusers spaced immediately therebelow. Sides 56 and 58 in combination with the curved portions of the side diffusers gradually direct the air streams downwardly towards the discharge slot to limit turbulence as would otherwise be generated if the air streams were abruptly directed in a different direction. Although a separate member 54 is illustrated, it should be understood the bottom surface of member 43 may be suitably modified to provide the necessary parallel sides 56 and 58.

It has been found, in order to obtain substantially uniform air flow from the two discharge slots, the various air streams created in the terminal should intermix "upstream" of such slots.

To further limit turbulence created as a result of the intermixing of the various air streams, member 54 further includes a vertical baffle member 62 extending downwardly from the lowest point of member 54 into mixing space 60. Baffle member 62 directs the portion of the air streams impinging thereon into a generally vertical flow path. Thus, the air streams flowing from passages 46 and 52 are directed parallel to the air streams flowing from passages 48 and 50 as the air streams enter mixing space 60. Baffle member 62 is preferably formed from sound absorbing material. By directing the air streams in parallel flow paths as the streams enter space 60, turbulence generated as a result of the intermixing of such streams will be further limited.

It should be understood, this invention contemplates the addition of further damper assemblies, with the air streams regulated thereby directed towards a single mixing space 60.

The foregoing structure permits the intermingling of four or more separate air streams without the creation of undue turbulence.

While a preferred embodiment of the instant invention has been described and illustrated, the invention should not be limited thereto, but may be otherwise embodied within the scope of the following claims.

I claim:

1. In an air conditioning terminal provided to discharge conditioned air into a space, the improvement comprising:

first and second damper assemblies with an outer wall of each assembly spaced from first and second vertically extending walls to define first and second air passages, and an inner wall of each assembly spaced from a third vertically extending wall to define third and fourth air passages, with said third and fourth passages being disposed radially inward relative to said first and second air passages, and said third vertically extending wall being disposed substantially on the vertical axis of said terminal; and a diffuser section comprising first and second side diffuser members having a third diffuser member interposed therebetween to define first and second air discharge openings substantially in vertical alignment with said third wall, said side diffuser members including a portion having a curved surface spaced from the sides of said third wall to define therebetween sections wherein the air moving through said first, second, third and fourth air passages is gradually directed towards a mixing space provided between the lower surface of said third wall and said first and second discharge openings.

2. The combination as set forth in claim 1 wherein said third wall is formed from sound absorbing material.

3. The combination as set forth in claim 2 wherein said third wall has a substantially isosceles-shaped triangular member affixed to the lower surface thereof, the sides of said triangular member being spaced from the curved surface of said side diffusers.

4. The combination as set forth in claim 1 wherein said third wall has a substantially isosceles-shaped triangular member affixed to the lower surface thereof, the sides of said triangular member being spaced from the curved surface of said side diffusers.

5. In an air conditioning terminal provided to discharge conditioned air into a space, the improvement comprising:

first and second damper assemblies, with an outer wall of each assembly spaced from first and second vertically extending walls to define first and second air passages, and an inner wall of each assembly spaced from a third vertically extending wall to define third and fourth air passages, with said third and fourth air passages being disposed radially inward relative to said first and second air passages and said third vertically extending wall being disposed substantially on the vertical axis of said terminal; and a diffuser section comprising first and second side diffuser members having a third diffuser member interposed therebetween to define first and second air discharge openings, said diffuser members being spaced below said third vertically extending wall to define a mixing space therebetween, with said third diffuser member being in substantially vertical axial alignment with said third wall, said side diffuser members including a portion having a curved surface spaced from the sides of said third wall to direct the air towards said mixing space, with said third wall including a vertical baffle member extending into said mixing space, with the air streams impinging thereon being directed in a generally vertical flow path into said mixing space, to minimize turbulence as the air streams intermix before exiting from the terminal through the discharge openings.

6. The combination as set forth in claim 5 wherein said third wall has a substantially isosceles-shaped triangular member affixed to the lower surface thereof, the sides of said member being spaced from the curved surface of said side diffusers, with said baffle member extending downwardly from the apex of said triangular member.

* * * * *